United States Patent [19]

Nomura et al.

[11] Patent Number: 4,757,773

[45] Date of Patent: Jul. 19, 1988

[54] PROGRAMMED PATTERN ALIGNING DEVICE FOR A SEWING MACHINE

[75] Inventors: Etsuzo Nomura, Kasugai; Shigeru Suzuki, Nagoya, both of Japan

[73] Assignee: Brother Kogyo Kabushiki Kaisha, Aichi, Japan

[21] Appl. No.: 115,867

[22] Filed: Nov. 2, 1987

[30] Foreign Application Priority Data

Nov. 15, 1986 [JP] Japan ..... 61-272675

[51] Int. Cl.[4] ..... D05B 19/00; D05B 27/06; D05B 27/14

[52] U.S. Cl. ..... 112/121.11; 112/153; 112/306

[58] Field of Search ..... 112/121.11, 121.12, 112/306, 313, 314, 319, 320, 153

[56] References Cited

U.S. PATENT DOCUMENTS 3,954,071 5/1976 Mall et al. .
4,159,687 7/1979 Masuda et al. ..... 112/306 X
4,541,347 9/1985 Kawaguchi et al. .
4,612,867 9/1986 Rosch et al. .
4,658,741 4/1987 Jehle et al. ..... 112/262.1
4,660,484 4/1987 Yasui ..... 112/121.11 X

FOREIGN PATENT DOCUMENTS 0044766 7/1980 European Pat. Off. .
60-28517 5/1985 Japan .
2131162 11/1982 United Kingdom .
2134650 1/1984 United Kingdom .
2146427 7/1984 United Kingdom .

*Primary Examiner*—Peter Nerbun
*Attorney, Agent, or Firm*—Parkhurst & Oliff

[57] ABSTRACT

A pattern aligning device for a sewing machine having two two-dimensional pattern sensors, first and second computing means and first and second actuating mechanisms. Responsive to the two-dimensional pattern data sensed by the sensors, the first and second computing means compute the displacements between the patterns on the two sheets of material in two directions. The calculated displacements in the two directions are actuated by the first and the second actuating mechanisms to correct the alignment of the two sheets of material during sewing.

7 Claims, 6 Drawing Sheets

PROGRAMMED PATTERN ALIGNING DEVICE FOR A SEWING MACHINE

BACKGROUND OF THE INVENTION

This invention relates to a pattern aligning device for a sewing machine for sewing two sheets of material in such manner that patterns on the two sheets of material are aligned during sewing.

A sewing machine of this type has been disclosed in the U.S. Pat. No. 4,612,867 to Rosch et al. In this document, the feed of either the upper or lower feeder is changed with respect to that of the other in accordance with a displacement of a pattern which is determined by processing pattern signals from a pair of pattern sensors. Thus, one of the two sheets of material is moved only in the sewing direction for adjusting the relative positions so that the patterns are correctly aligned.

The prior art sewing machines are able to align such one-dimensional patterns laying transverse to the sewing direction, i.e., horizontal or diagonal stripe patterns. The prior art machines, however, cannot align either two-dimensional intersecting patterns (such as check patterns) or patterns laying in the sewing direction (such as vertical stripes).

SUMMARY OF THE INVENTION

Accordingly, it is an object of this invention to provide a pattern aligning device for a sewing machine to correctly align the relative positions of two sheets of material when the same two-dimensional patterns, patterns laying in two intersecting directions or laying in the sewing direction are disaligned between the two sheets.

This object and related objects are realized by the pattern aligning device for the sewing machine of the present invention for aligning patterns on two sheets of material, including: pattern sensing means for two-dimensionally sensing the patterns; first computing means for generating a first displacement datum, which represents a relative displacement between the two patterns in a first direction; second computing means for generating a second displacement datum, which represents a relative displacement between the two patterns in a second direction which intersects the first direction; first movement means for effecting a relative movement between the two sheets of material in the first direction; second movement means for effecting a relative movement between the two sheets of material in the second direction; and control means responsive to the first and the second displacement data for controlling the first and second movement means to align the patterns on the two sheets of material in both the first and second directions. Preferably, the first direction is the sewing direction and the second direction is perpendicular to the sewing direction.

According to another aspect of the invention, the pattern aligning device includes: stitch forming means; upper feeding means and lower feeding means for cooperatively feeding said two sheets of material passing through said stitch forming means in a sewing direction; first actuating means operatively connected with at least one of said two feeding means for effecting the relative movement between the two sheets of material; transverse feeding means for feeding at least one of said two sheets of material in a transverse direction intersecting the sewing direction; second actuating means operatively connected with said transverse feeding means for effecting the relative movement between the two sheets of material; pattern sensing means for two-dimensional sensing of said patterns; first computing means for generating a first displacement datum, the first displacement data representing a relative displacement between the two patterns in said sewing direction; second computing means for generating a second displacement datum, the second displacement data representing a relative displacement between the two patterns in said transverse direction; control means responsive to the first and the second displacement data for controlling said first and second actuating means to align said patterns on said two sheets of material in both of the two directions.

BRIEF DESCRIPTION OF THE DRAWINGS

The invention will now be described with reference to the accompanying drawings, wherein.

DETAILED DESCRIPTION OF PREFERRED EMBODIMENT

Figure 1:
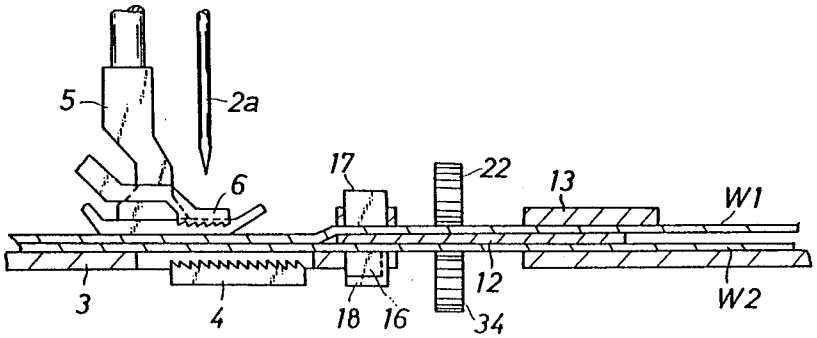
FIG. 1 is a sectional view along the sewing direction of a sewing machine as an embodiment of this invention.
Figure 2:
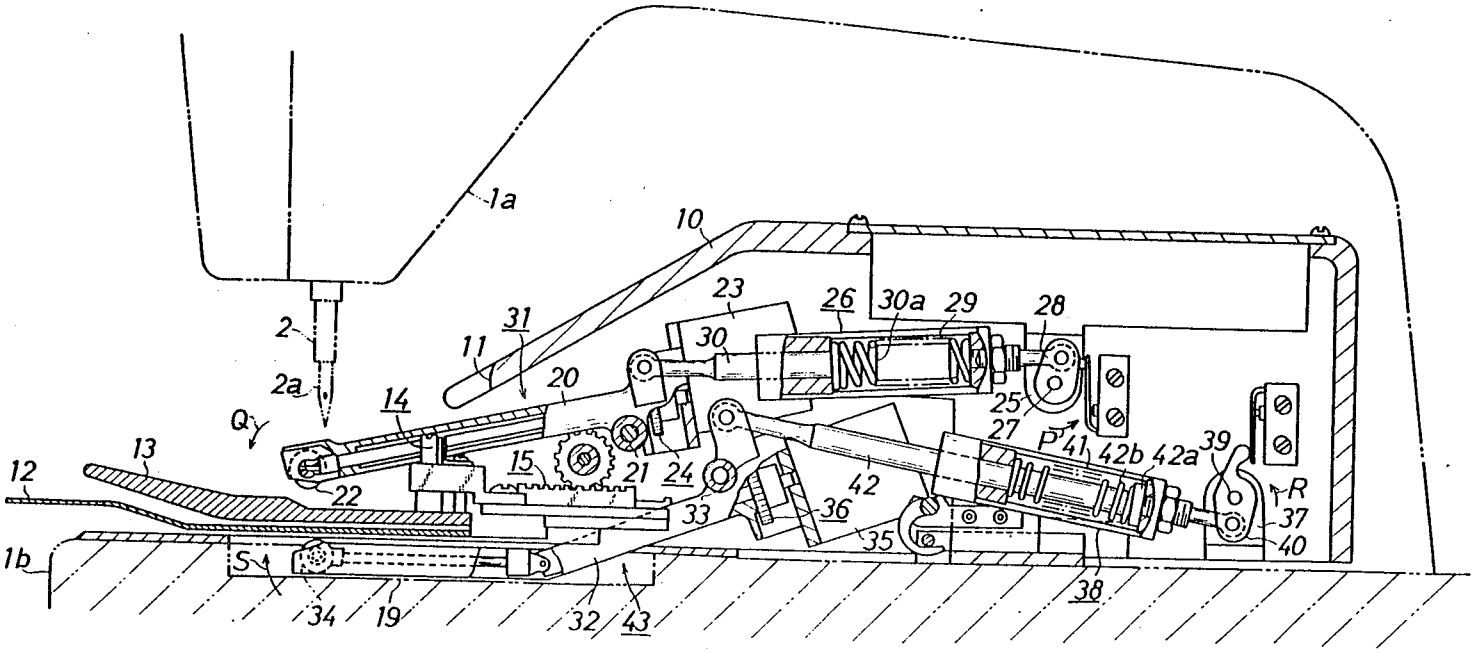
FIG. 2 is a cross-sectional view of a pattern aligning device of the embodiment.

An embodiment of this invetion is set forth in detail according to the drawings. As shown in FIG. 2, a needle *2a* attached to a needle bar 2 is provided at the lower end of a machine head 1*a*. The needle *2a*, which reciprocates through a hole in a needle plate 3 on a machine bed 1*b*, as shown in FIG. 1, cooperates with a loop taker (not shown) in the machine bed 1*b* so that two cloths W1 and W2 are sewn together. Near the needle dropping point, a lower feed dog 4 which functions as a lower feeding means is installed below the needle plate 3 to effect the 4 motion feed. Upper feed dogs 6 functioning as upper feeding means are provided on both sides of a presser foot 5. The upper feed dogs 6 also effect 4 motion feed. By the cooperation of the lower feed dog 4 and the upper feed dogs 6, the upper and lower cloths W1 and W2 are fed.

Figure 5:
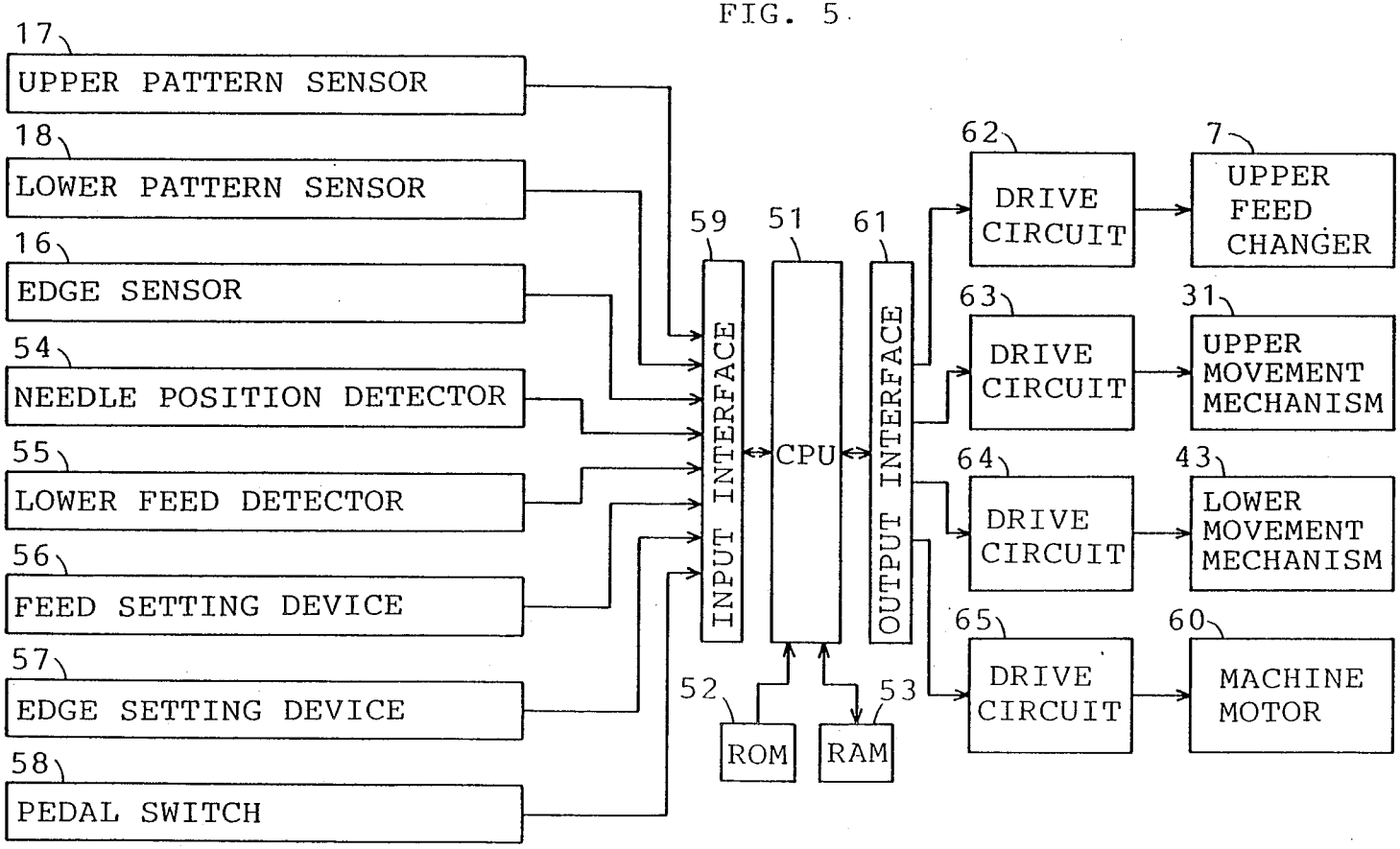
FIG. 5 is a block diagram illustrating a schematic structure of the sewing machine of the present invention.

An upper feed changer 7 shown in FIG. 5 is operatively connected to the upper feed dogs 6, which give auxiliary feed to only the upper cloth W1. The upper feed changer 7 includes a pulse motor (not shown) which is operatively connected to the upper feed dogs 6. When a control signal is input externally to the pulse motor, the feed pitch of the upper feed dogs 6 is changed relatively with respect to the lower feed dog 4, producing a relative movement between the upper and lower cloths W1 and W2 in the sewing direction. The upper feed dogs 6, the lower feed dog 4 and the upper feed changer 7 essentially compose the first movement means of the invention; the upper feed changer 7, especially the pulse motor, constitute the first actuating means. The upper feed changer 7 is detailed in the U.S.

patent application Ser. No. 14,583 filed on Feb. 13, 1987 with the same assignee.

Figure 3:
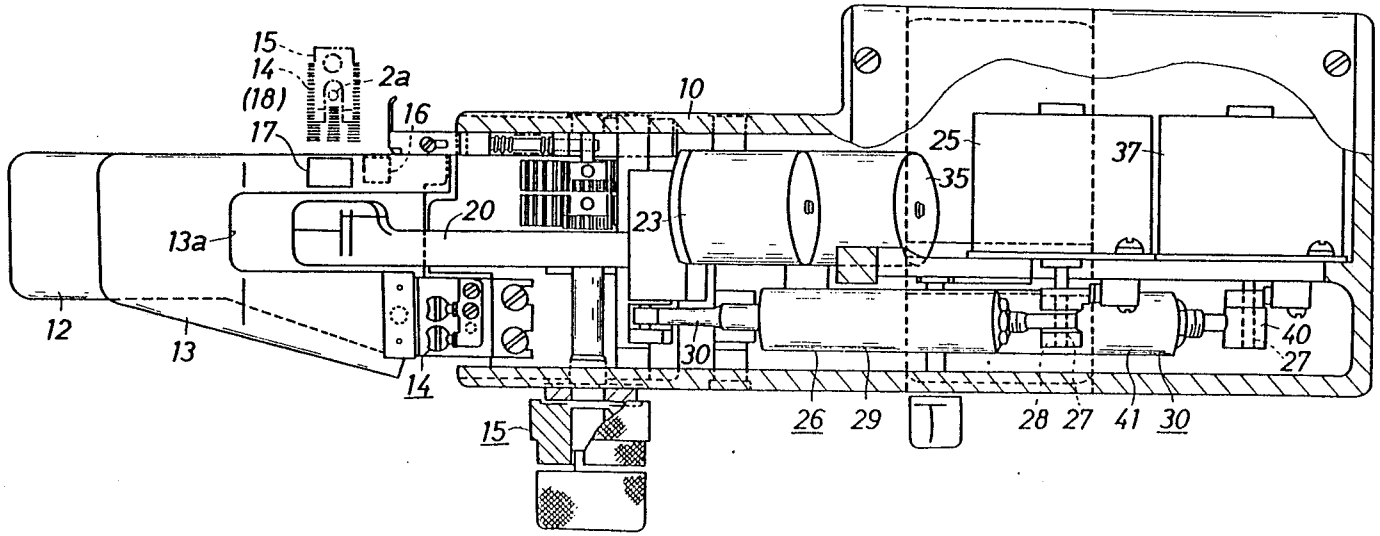
FIG. 3 is a sectional plan view of the pattern aligning device of the embodiment.

As shown in FIGS. 2 and 3, a housing 10 having a left opening 11, with respect to the sewing direction, is set on the machine bed 1b at the right of the needle bar 2. Upstream from the needle dropping point and near the opening 11, a separating plate 12 and an upper plate 13 lay horizontal at preset intervals from the bed 1b and each other. The separating plate 12 and the upper plate 13 are connected to a vertical position adjuster 14 and a horizontal position adjuster 15 in the housing 10. The intervals between the upper surface of the machine bed 1b and the separating plate 12, and between the separating plate 12 and the upper plate 13, as well as the horizontal position of the plates 12 and 13, are adjusted by the adjusters 14 and 15. The adjusters 14 and 15 are disclosed in more detail in the U.S. Pat. No. 4,541,347 of the same assignee.

As shown in FIGS. 1 and 3, an edge sensor 16 including a light emitting diodes and a light receiver is provided on the machine bed 1b under the separating plate 12. The light receiver of the sensor 16 is formed by a plurality of light detectors aligned linearly in a transverse direction to the sewing direction. The sensor 16 detects the position of the side edge of the lower cloth W2 and outputs a signal. A central processing unit (CPU) 51 described later determines the direction and extent that the current side edge of the lower cloth is displaced from the desired point based on the signal from the sensor 16. The sensor 16 is detailed in Japan published examined patent application No. 60-28517.

At the left of the edge sensor 16, a sensor 17 for detecting a pattern of the upper cloth W1 is provided on the upper plate 13 and a sensor 18 for detecting a pattern of the lower cloth W2 is provided on the machine bed 1b. They face each other in opposition with the cloths W1 and W2 therebetween. The pattern sensors 17 and 18 are two-dimensional image sensors which sense the patterns of each cloth W1 and W2 to output a signal of the sensed pattern.

Figure 4A:
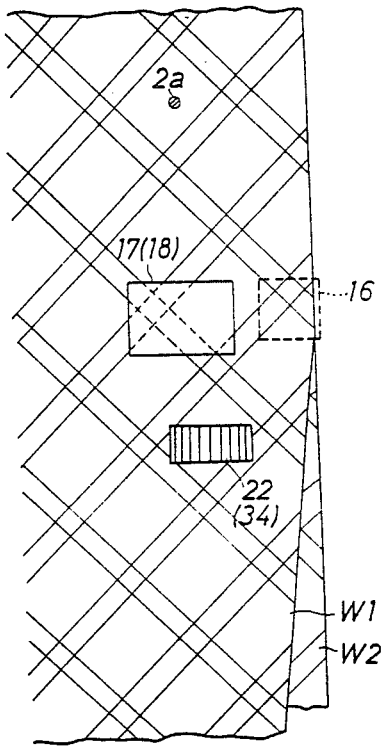
FIG. 4A illustrates a positional relationship between two cloths and a pair of pattern sensors.
Figure 4B:
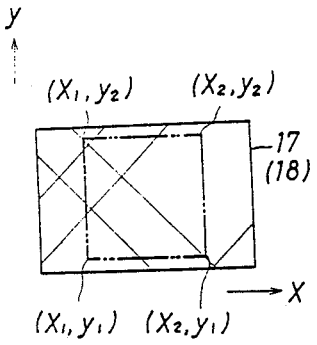
FIG. 4B is an explanatory view showing how a pattern is detected.

The sensed pattern signal is constituted by image data of the patterns on the cloths W1 and W2 in a rectangular frame $(x_1, y_1)-(x_1, y_2)-(x_2,y_2)-(x_2, y_1)$ as shown in FIG. 4B. Based on the image data, a displacement value n in the sewing direction (y-axis) and a displacement value m in the transverse direction (x-axis perpendicular to the y-axis) are calculated by the following procedure.

Suppose the image data from the pattern sensors 17 and 18 at a point (x,y) is described by brightness f(x,y) and g(x,y) respectively, a correlation function R(m,n) of the brightness functions f(x,y) and g(x,y) is represented by the following equation.

$$R(m,n) = \int_{y_1}^{y_2} \int_{x_1}^{x_2} f(x-m, y-n) \cdot g(x,y)dxdy$$

Here, $x_1$, $x_2$, $y_1$ and $y_2$ are boundaries of the rectangular sensing area. The function R(m,n) indicates a pattern alignment in the range of $x_1 \leqq x \leqq x_2$ and $y_1 \leqq y \leqq y_2$, and is a function of parameters m and n. The values of m and n at which the correlation function R(m,n) is a maximum give displacement values of the upper cloth W1 relative to the lower cloth W2 in the directions of x-axis and y-axis.

The CPU 51 calculates the values of m and n at which R(m,n) is maximum under the condition that the parameters m and n are in the range, $$-|x_2-x_1| \leqq m \leqq |x_2-x_1| \text{ and}$$

$$-|y_2-y_1| \leqq n \leqq |y_2-y_1|.$$

The displacing direction of the patterns (or of the cloths W1 and W2) is determined by the sign of the parameters m and n.

As shown in FIGS. 2 and 3, an upper arm 20 pivots around a pin 21 in the housing 10. The end of the upper arm 20 extends out of the housing 10 to just above an opening 13a of the upper plate 13. A wheel 22 reachable to the upper cloth W1 through the opening 13a of the upper plate 13 is rotatably supported at the end of the upper arm 20. The wheel 22 is driven to rotate by a servo motor 23 attached at the base of the upper arm 20 via transmission gears 24. The servo motor 23 composes the second actuating means of the invention.

A resilient link 26 is provided in the housing 10 between a pulse motor 25 and the upper arm 20. The resilient link 26 consists of a cylinder 29, a rod 30 and a spring 30a. The cylinder 29 is connected to an output axis 27 of the pulse motor 25 by means of a crank arm 28. The rod 30 is slidably housed within the cylinder 29 and its outside end is pivotally connected near the base of the upper arm 20. The spring 30a is provided in the cylinder 29 so as to urge the rod 30 outward.

When the upper arm 20 is located as shown in FIG. 2, and the pulse motor 25 is rotated in the direction of the arrow P, the upper arm 20 pivots in the direction of the arrow Q by means of the pivotal arm 28 and the resilient link 26. Therefore, the wheel 22 touches the upper cloth W1. When the pulse motor 25 is subsequently rotated by a preset angle in the direction of the arrow P, the spring 30a is compressed in the cylinder 29, and the wheel 22 presses the upper cloth W1 by the spring's force. The upper arm 20, the wheel 22, the servo motor 23 for the upper cloth W1, the resilient link 26 and the pulse motor 25 compose an upper transverse movement mechanism 31 which is in the second movement means of the invention.

A lower arm 32 is provided under the upper arm 20 in the housing 10. The lower arm 32 is composed of two parts connected by a universal joint; the right part also pivots on a pin 33. The left part of the lower arm 32 lies within a groove 19 on the machine bed 1b which extends out of the housing 10 just below the lower separating plate 12. Another wheel 34 reachable to the lower cloth W2 is rotatably supported at the end of the left part of the lower arm 32. The wheel 34 is rotated by another servo motor 35 attached to the base of the lower arm 32 via another transmission gear 36.

Another resilient link 38 is provided in the housing 10 between a pulse motor 37 and the lower arm 32. The resilient link 38 comprises a cylinder 41, a rod 42 and a spring 42b. The cylinder 41 is connected to an output axis 39 of the pulse motor 37 by means of a crank arm 40. The rod 42 is slidably housed within the cylinder 41 and its outside end is pivotally connected near the base of the lower arm 32. The spring 42b is provided between the inner end surface of the cylinder 41 and a flange 42a of the rod 42 so as to urge the rod 42 inward.

When the lower arm 32 is located as shown in FIG. 2, and the pulse motor 37 is rotated in the direction of the arrow R, the lower arm 32 is rotated in the direction of an arrow S by means of the pivotal arm 40 and the resilient link 38. Thus the wheel 34 touches the lower cloth W2. When the pulse motor 37 is subsequently rotated by a preset angle in the direction of the arrow R, the spring 42*b* is compressed in the cylinder 41, and the wheel 34 is push up on the lower cloth W2 by the spring force. The lower arm 32, the wheel 34, the servo motor 35, the resilient link 38, and the pulse motor 37 compose a lower transverse movement mechanism 43.

An electronic structure of the sewing machine is set forth according to FIG. 5. Read Only Memory (ROM) 52 and Random Access Memory (RAM) 53 are connected to the CPU 51 which functions as a control device. The ROM 52 stores programs for controlling all operations of the sewing machine. The RAM 53 includes regions for storing the preset margin data and image data of sensed patterns of cloths W1 and W2.

The CPU 51 is connected to: the upper pattern sensor 17; the lower pattern sensor 18; the edge sensor 16; a needle position detector 54 for detecting vertical position of the needle 2*a;* a lower feed detector 55 for detecting the feed amount of the lower feed dog 4; a feed setting device 56 for setting the feed amount of the feed dogs 4 and 6; an edge setting device 57 for setting the edge; and a pedal switch 58. Thus, various signals from those devices are input to the CPU 51 via an input interface 59. Moreover, the CPU 51 is connected to: the upper feed changer 7; the upper transverse movement device 31; the lower transverse movement device 43; and a machine motor 60. A drive or stop signal is output from the CPU 51 to these via an output interface 61 and driving circuit 62 through 65.

During sewing, the CPU 51 compares the sensed data from the edge sensor 16 and the edge data previously set by the edge setting device 57 at preset times based on a sensed signal of the needle position detector 54. The CPU 51 then calculates the feed in the transverse direction based on the comparison result, or a displacement of the side edge of the lower cloth W2. Based on the calculated feed, a correction signal is output to the lower movement mechanism 43.

Furthermore, the CPU 51 processes image data of the patterns sent from the pattern sensors 17 and 18 at every preset timing based on a signal from the needle position detector 54, and calculates the displacement values n and m according to the aforementioned equation. Then the CPU 51 calculates the change in the feed amount in the sewing direction of the upper cloth W1 and in the move amount in the transverse direction of the upper cloth W1, and outputs a correction signal to the upper feed changer 7 and the upper transverse movement mechanism 31.

Figure 6:
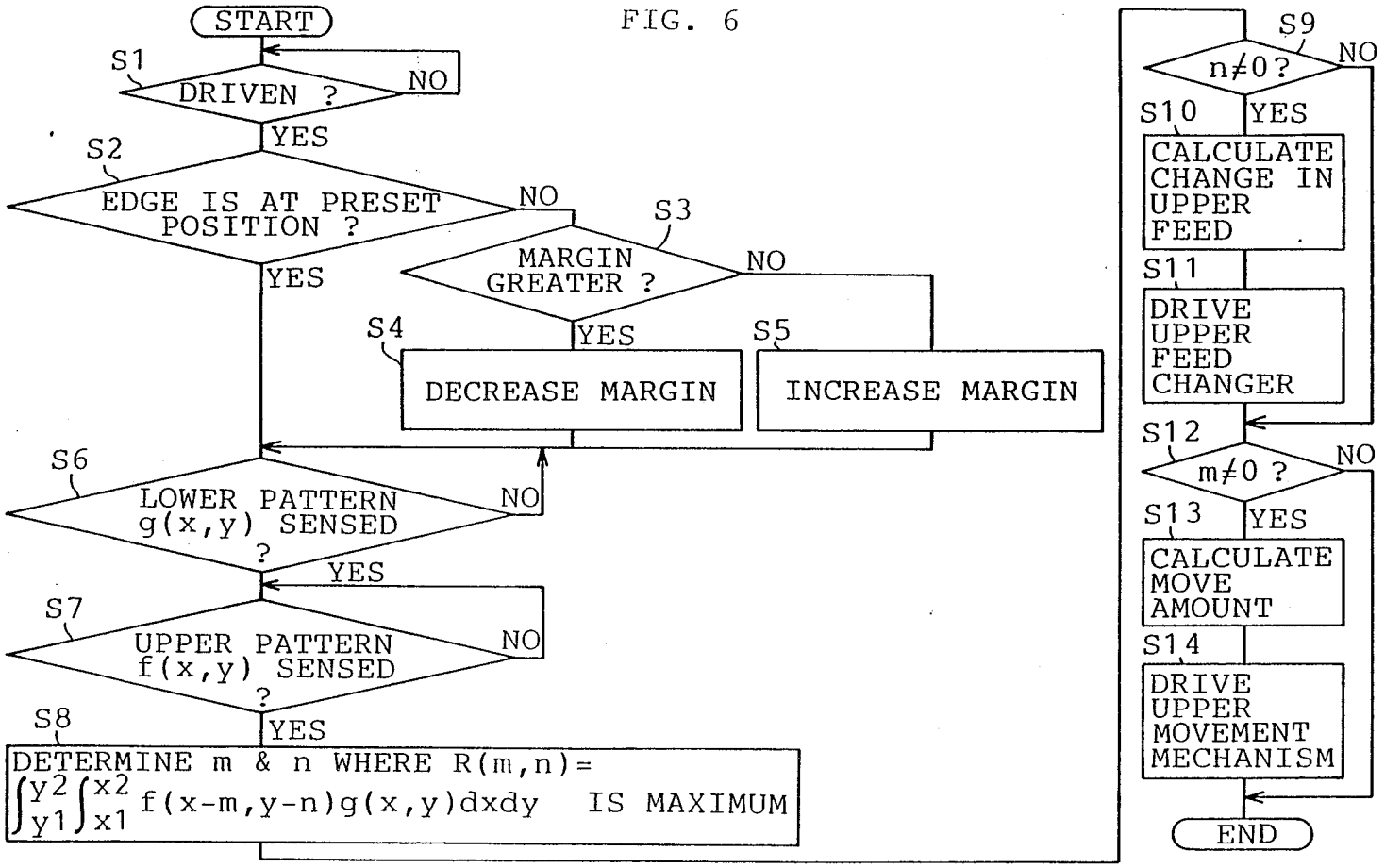
FIG. 6 is a flow chart for aligning the edges of two sheets of cloth and for aligning a pattern.

Next, the operation of the sewing machine is described according to FIG. 6. During sewing, a routine of a flow chart shown in FIG. 6 is executed by the CPU 51 at every preset timing based on a sensed signal from the needle position detector 54. At S1, it is determined whether the machine motor 60 is driven by sensing the state of the pedal switch 58. If the answer is NO, S1 is repeated until the machine motor 60 is driven. If the answer is YES, the program proceeds to S2 at which it is determined whether the stitch margin (distance from the edge to the needle dropping point) of the lower cloth W2 is equal to a preset value, i.e., the edge is located at a preset position, by comparing data sensed by the edge sensor 16 with the preset edge data. If the answer is NO at S2, the program proceeds to S3 at which it is determined whether the current margin is greater than the preset value. If the answer is YES at S3, the program proceed to S4 at which the displacing amount of the lower cloth W2 is calculated to place the edge at the desired position, and the wheel 34 of the lower movement mechanism 43 is driven to decrease the margin. If the answer is NO at S3, the program proceeds to S5 at which the displacing amount of the lower cloth W2 is calculated based on the preset edge position, and the wheel 34 of the mechanism 43 is driven to increase the margin. Accordingly, sewing can be continued with the constant preset margin.

If the answer is YES at S2, or after S4 or S5, the program proceeds to S6 at which it is determined whether a pattern of the lower cloth W2 is sensed by the lower pattern sensor 18. If the answer is NO, S6 is repeated until the pattern of the lower cloth W2 is sensed. At S7, it is determined whether a pattern of the upper cloth W1 is sensed by the upper pattern sensor 17. If the answer is NO, S7 is repeated until the pattern of the upper cloth W1 is sensed. At S8, displacement values n and m in both the sewing and transverse directions of the upper cloth W1 is calculated based on the image data of the pattern sensors 17 and 18. Then, at S9, it is determined whether there is disalignment of the pattern in the sewing direction. If the answer is YES, at S10, change in the upper feed is calculated based on the displacement value n. Then, at S11, the upper feed changer 7 is driven to correct the feed. At S12, it is determined whether there is disalignment of the pattern in the transverse direction. If the answer is YES, at S13, the amount of movement of the upper cloth W1 in the transverse direction is calculated based on the displacement value m. At S14, the wheel 22 of the upper movement mechanism 31 is driven to correct the displacement of the cloth W1 relative to the cloth W2 in the direction of x-axis according to the calculated result. Then, the CPU 51 repeats the routine of FIG. 6 according to the timing of the needle position detector 54.

Accordingly, when the two cloths W1 and W2 are disaligned in both the sewing and transverse directions, the upper cloth W1 is correctly adjusted in the both directions with respect to the lower cloth W2 by operating the upper feed changer 7 and the lower movement mechanism 31. Thus, two cloths W1 and W2 can be sewn while correctly aligning patterns even if the pattern is checkered as shown in FIG. 4A.

As many apparently widely different embodiments of this invention may be made without departing from the spirit and scope thereof, it is to be understood that the invention is not limited to the specific embodiments thereof except as defined in the appended claims.

What is claimed is:

1. A pattern aligning device for a sewing machine for sewing two sheets of material in such a manner that patterns on the two sheets of material are aligned, comprising:

pattern sensing means for two-dimensionally sensing said patterns;

first computing means for generating a first displacement datum which represents a relative displacement between the two patterns in a first direction;

second computing means for generating a second displacement datum which repesents a relative displacement between the two patterns in a second direction which intersects the first direction;

first movement means for effecting a relative movement between said two sheets of material in said first direction;

second movement means for effecting a relative movement between said two sheets of material in said second direction; and control means responsive to the first and the second displacement data for controlling said first and second movement means to align said patterns on said two sheets of material in both the first and second directions.

2. A pattern aligning device according to claim 1, wherein said first direction is a sewing direction and said second direction is a direction perpendicular to the first direction.

3. A pattern aligning device for a sewing machine for sewing two sheets of material in such a manner that patterns on the two sheets of material are aligned, comprising:

stitch forming means;

upper feeding means and lower feeding means for cooperatively feeding said two sheets of material passing through said stitch forming means in a sewing direction;

first actuating means operatively connected with at least one of said two feeding means for effecting the relative movement between the two sheets of material;

transverse feeding means for feeding at least one of said two sheets of material in a transverse direction intersecting the sewing direction;

second actuating means operatively connected with said transverse feeding means for effecting the relative movement between the two sheets of material;

pattern sensing means for two-dimensionally sensing said patterns;

first computing means for generating a first displacement datum which represents a relative displacement between the two patterns in said sewing direction;

second computing means for generating a second displacement datum which represents a relative displacement between the two patterns in said transverse direction;

control means responsive to the first and the second displacement data for controlling said first and second actuating means to align said patterns on said two sheets of material in both of the two directions.

4. A pattern aligning device according to claim 3, wherein:

said upper feeding means include an upper feed dog; and said lower feeding means include a lower feed dog.

5. A pattern aligning device according to claim 3, wherein said transverse feeding means include a roller whose axis is held parallel to said sewing direction.

6. A pattern aligning device according to claim 3, wherein said pattern sensing means include two two-dimensional image sensors each for sensing the pattern in a preset rectangular frame.

7. A pattern aligning device according to claim 6, wherein:

said two image sensors generate brightness signal f(x,y) and g(x,y) respectively as a function of points (x,y) in the rectangular frame; and said first and second computing means generate displacement data m and n respectively, the data m and n being determined as those values that maximize an integral $$\int_{y_1}^{y_2} \int_{x_1}^{x_2} f(x-m, y-n) \cdot g(x,y)\,dx\,dy.$$

* * * * *